United States Patent [19]

Niimi

[11] Patent Number: 4,929,942

[45] Date of Patent: May 29, 1990

[54] LIGHTING PEG

[75] Inventor: Kikuo Niimi, Aichi, Japan

[73] Assignee: Kictec Incorporation, Aichi, Japan

[21] Appl. No.: 282,435

[22] Filed: Dec. 9, 1988

[30] Foreign Application Priority Data

Apr. 11, 1988 [JP] Japan ..... 63-47741[U]

[51] Int. Cl.[5] ..... E01F 9/00; G08G 1/00; B60Q 7/00

[52] U.S. Cl. ..... 340/908.1; 340/908; 340/427; 340/321; 340/917; 340/942; 315/149; 315/155; 315/159; 250/215; 250/239; 307/10.8

[58] Field of Search ..... 340/917, 942, 908, 908.1, 340/432, 427, 469, 473, 321; 362/900; 315/82, 155, 159, 149; 250/215, 239; 307/10.8

[56] References Cited

U.S. PATENT DOCUMENTS

| | | | |
|---|---|---|---|
| 3,790,848 | 2/1974 | Lai | 315/155 |
| 3,901,813 | 8/1975 | Potopinski | 315/155 |
| 3,965,388 | 6/1976 | Brisk | 315/155 |
| 4,290,047 | 9/1981 | Latta, Jr. | 315/149 |

FOREIGN PATENT DOCUMENTS

| | | |
|---|---|---|
| 39915 | 9/1977 | Japan . |
| 95686 | 6/1985 | Japan . |
| 68113 | 5/1986 | Japan . |

*Primary Examiner*—Donnie L. Crosland
*Attorney, Agent, or Firm*—Ladas & Parry

[57] ABSTRACT

A lighting peg having a solar cell and a battery installed in a casing including a number of sensors each including a photoelectric conversion element mounted on a side surface of the casing, a differential circuit provided on the subsequent stage of the conversion element, and a comparator which delivers a high level output when the output of the differential circuit exceeds a predetermined value. A multivibrator generating a series of pulses, and a counter for counting a predetermined number of pulses are also provided, so that when either of the sensors detect light having a variation rate larger than a predetermined value, the multivibrator starts generating pulse for energizing a number of light-emitting elements also provided on the side surface of the casing, and the flashing operation of the light-emitting elements continues even after the termination of the detection of the aforementioned condition, until the counter starting the operation at that terminating instant completes the counting of the predetermined number of pulses.

7 Claims, 2 Drawing Sheets

LIGHTING PEG

BACKGROUND OF THE INVENTION

This invention relates to a lighting peg which is installed, for instance, at the center of road intersections along the center line of roads or in vehicle stop lines where vehicles stop temporarily.

Heretofore, various devices for the above described use have been proposed. One such device is an automatic flashing lamp for indicating the edges (or shoulders) of roads, where a first photoelectric conversion element senses the ambient light, while a second photoelectric conversion element senses the light from a vehicle, has been disclosed in Japanese Utility Model Publication No. 39915/1977. Also proposed is a road marking device wherein the ambient light is detected from the output voltage of a solar cell, while the light from a vehicle is sensed by a photoelectric conversion element, and a pulsating light emitting diode is thereby operated (refer to Japanese Utility Model Laid-Open Publication No. 68113/1986). Also proposed is a marking plate wherein a photoelectric conversion element is utilized, and when the element receives light from a vehicle at night, an oscillator operates a light-emitting diode in a pulsating manner, but when light is continuously received in the day time or at night, a counter provided therein turns off the light-emitting diode (refer for instance to Japanese Utility Model Laid-Open Publication No. 95686/1985 which was filed by the applicant of this invention).

However, according to the sensing method of the first and second conventional devices mentioned, the operation tends to be delayed or made inoperative even at night, if there are street lamps or the like provided nearby the device, and also in cases where the weather is cloudy or the area is dark. Otherwise, when the sensible distance of vehicle light has been set to be long, erroneous operation tends to occur in the evening unless the photoelectric element is adjusted to be operable in comparatively dark conditions. Furthermore, when the device comprises serially connected analog circuits composed of transistors or the like, the two photoelectric conversion elements provided in the device tend to interfere with each other in the low illumination region, thus rendering adjustment extremely difficult.

According to the third conventional technique mentioned, although no erroneous operation due to the ambient condition has been recognized, the setting of the detectable distance of an incoming vehicle requires the adjustment of variable resisters with a model vehicle having its lights turned on and positioned at a predetermined position. Furthermore, the detectable distance thus set does not always correspond to the practical value because the light of a vehicle is not always of constant brightness.

SUMMARY OF THE INVENTION

This invention is directed to overcome the above described difficulties of the conventional devices.

An object of the present invention is to provide a lighting peg capable of eliminating erroneous operation regardless of whether it is night, evening, or early morning.

Another object or the invention is to provide a lighting peg wherein a vehicle sensing distance corresponding to a practical value is always obtained without the necessity for initial adjustment.

These and other objects of the invention can be achieved by a lighting peg comprising an outer casing, a solar cell provided on an upper surface of the casing, a battery provided in the casing, a photoelectric conversion element provided on a side surface of the casing and a series connected with a variable resistor, a differential circuit connected to the output side of the photoelectric conversion element, a comparator comparing the output of the differential circuit with a reference voltage, a multivibrator which generates output pulses when the output of the comparator is at the high level, a counter which begins counting the pulses generated from the multivibrator when the output of the comparator becomes low level and which stops operation of the multivibrator when the counter counts a predetermined number of pulses, and a plurality of light emitting elements provided on the side surface of the casing to be operable in a pulsating manner when the multivibrator is operated.

The photoelectric conversion element, differential circuit, and the comparator in combination constitute a vehicle sensor which delivers a high level output when the variation rate of the light received from an incoming vehicle is larger than a predetermined value.

DESCRIPTION OF THE PREFERRED EMBODIMENTS

A preferred embodiment of the present invention adapted for use at intersections will now be described with reference to the accompanying drawings.

Figure 1:
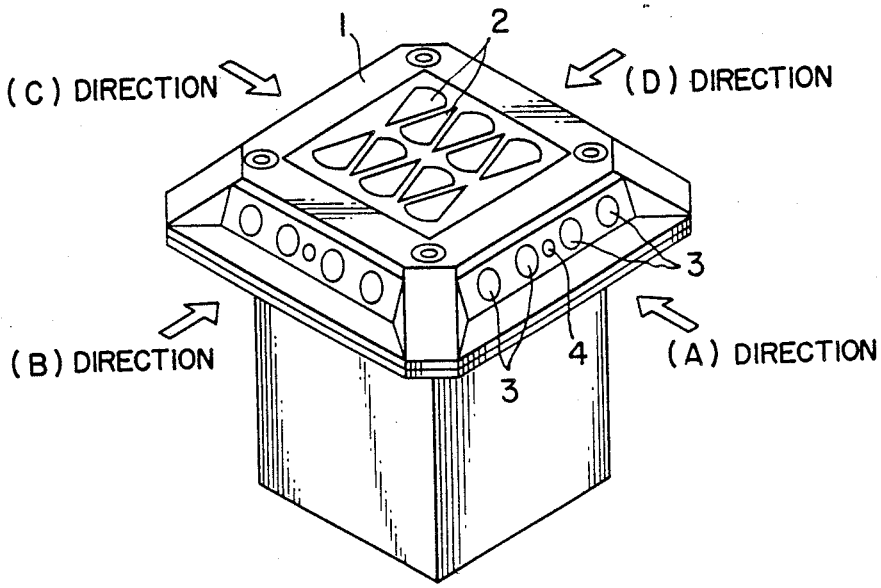
FIG. 1 is a perspective view showing a preferred embodiment of the invention.
Figure 2:
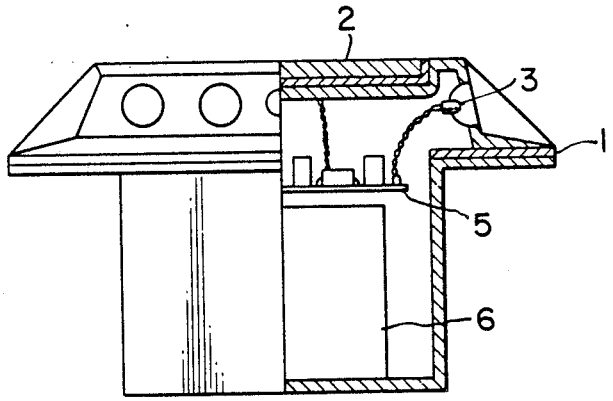
FIG. 2 is an elevational view, partly in section, showing the embodiment.

A lighting peg of this embodiment comprises an outer casing (or structural member) 1 formed into a square shape as shown in FIGS. 1 and 2. On the upper surface of the casing 1 is provide a solar cell 2, while a number of light emitting diodes 3 and a phototransistor 4 operable as a photoelectric conversion element are provided on each side surface of the square casing 1. A control circuit 5 and a battery 6 are installed in the casing 1.

Figure 3:
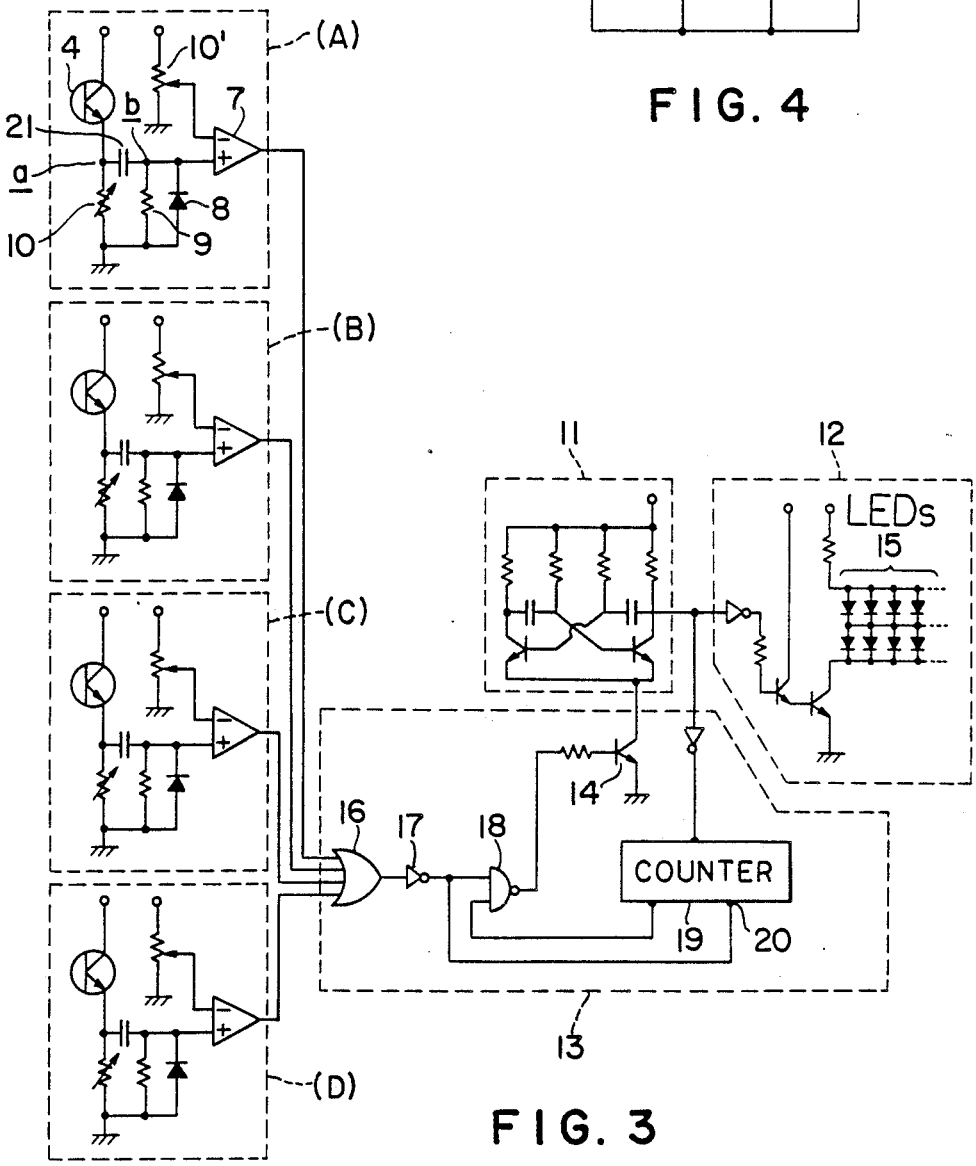
FIG. 3 is a diagram showing a control circuit used in the embodiment.

FIG. 3 illustrates the control circuit 5 comprising vehicle sensors A, B, C, and D capable of sensing the light of a vehicle coming toward the intersection from either of four directions A, B, C, and D a multivibrator 11, a light-emitting diode energizing circuit 12 and an energization control circuit 13. Each of the vehicle sensors (A), (B), (C), and (D) comprises a phototransistor 4 and a variable resistor 10 series connected with the phototransistor 4, the variable resistor 10 is adjusted so that the voltage of a junction point a between the phototransistor 4 and the variable resistor 10 is made equal to $V_{DD} - 1$ V. A differential circuit comprising a capacitor 21 and a resistor 9 is provided at the subsequent stage for differentiating the voltage of the point a. The output of the differential circuit is delivered from a point b. In a case where the voltage of the point a rises, the voltage of the point b also rises. However, when the voltage of the point a is held at a constant value, the voltage of the point b is reduced to zero after the elapse of a time determined by the capacitor 21 and the resistor 9. In the case where the voltage of the point a falls, the voltage of the point b also falls to a value of zero or less. However, a diode 8 connected across the resistor 9 in reverse polarity returns the voltage of the point b to zero in a short time. The voltage of the point b is applied to a comparator 7.

The energization control circuit 13 comprises an 0R gate 16 which receives the output of the comparators 7 in the vehicle sensors (A), (B), (C), and (D), an inverter 17 which inverts the output of the OR gate 16, a counter 19 counting the output pulses of the multivibrator 11, a NAND gate 18 receiving the output of the inverter 17 and also the output of the counter 19, and a transistor 14 which in response to the output of the NAND gate 18 starts operating the multivibrator 11.

The operation of the embodiment with now be described.

When a power source voltage is applied, the voltage of the points a in each of the vehicle sensors (A), (B), (C), and (D) is not varied, and therefore the voltage of the points b is held at zero volts. At this time since the voltage applied to the comparator 7 is lower than the reference voltage, the output of the comparator 7 becomes low level. Since all the inputs of the OR gate 16 are likewise held at a low level, the output of the OR gate 16 becomes low level. The output of the OR gate 16 is applied through the inverter 17 to an input of the NAND gate 18 and also to a reset terminal 20 of the counter 19. Since the output of the counter 19 is held at the low level in the case where the counter 19 has not yet counted a predetermined number of pulses, the output of the NAND gate becomes high level. As a consequence, the transistor 14 is operated to start operating the multivibrator 11 and to start pulsation of the light-emitting diodes 15.

When the counter 19 starts the counting operation as described hereinafter, and a predetermined number of pulses has been counted, the output of the counter 19 becomes high level, and the output of the NAND gate 18 is thereby made low level. As a consequence, the operation of the transistor 14 is terminated, and the operations of the multivibrator 11 and the light-emitting diodes 15 are interrupted.

In the evening when it becomes dark, the voltage of the point a is gradually reduced. However, the voltage of the point b is held at zero volt because of the gradual variation of the voltage of the point a, and therefore the output of the comparator 7 is held at low level, and the light-emitting diodes 15 are thereby held in the turned-off state.

In the case where a vehicle comes to the intersection at night, a current flows through the phototransistor 4 and the voltage of the point a suddenly rises . The voltage of the point b therefore rises rapidly, and when the voltage of the point b exceeds the reference voltage set by a variable resistor 10', the output of the comparator 7 and therefore the output of the OR gate are made high level. The input of the reset part (20) of the counter 19 also becomes high level and so the two inputs of the NAND gate 18 are held at a low level, and the output of the NAND gate 18 becomes high level. As a consequence, transistor 14 starts to operate the multivibrator 11 so that the light-emitting diodes are operated. On the other hand, the high level of the output of the OR gate 16 prohibits counting operation of the counter 19, leaving the output thereof at a low level.

When a vehicle comes into the proximity of the intersection, and the rate of increase of the received light is reduced, the rate of increase of the voltage of the point a is also reduced. As a result, the voltage of the point b is reduced to a value nearly equal to zero volts. At the instant when the voltage of the point b is reduced in excess of the reference voltage, the output of the comparator 7 becomes low level, thereby changing the output of the OR gate 16 to low level. Thus, the output of the inverter 17 is made high level, and the voltage of the reset terminal 20 of the counter 19 is made low level. However, the output of the counter 19 is still held at low level, and therefore, the output of the NAND gate 18 is maintained at high level, and the multivibrator 11 is thereby continuously operated. The continuous operation of the multivibrator 11 continuously operates the light-emitting diodes, and the counter 19 counts the number of pulses, when the counter 19 counts a predetermined number of pulses, the output thereof becomes high level and the output of the NAND gate 18 is reduced to low level. Thus, the operation of the transistor 14 is terminated, and the oscillation of the multivibrator 11 as well as the pulsation of the light-emitting diodes are stopped. When the vehicle passes through the intersection, the voltage of the point a is reduced to zero volt, and the voltage of the point b is reduced to a negative value. However, the diode 8 connected across the resistor 9 in a reverse polarity returns the voltage of the point b to zero volts. As a consequence, the output of the comparator 7 is held at a low level, and the conditions of the OR gate 16 and the circuits subsequent thereto and including light-emitting diodes 15 are all held in the not-operating state.

In the morning, the quantity of light received by the phototransistor 4 increases and the voltage of the point a rises. However, the rate of increase is slow and hence the voltage of the point b is held at nearly equal to zero volts far lower than the reference voltage. Accordingly, the output of the comparator 7 is held at a low level and the light emitting diodes 15 are not operated.

In an additional feature of the operation of this embodiment, when traffic is congested with vehicles running at slow speed, and the pulsation of the light-emitting diodes 15 is not required, the variation of the voltages at the points a and b becomes negligible, and the output of the comparator 7 is held at low level. Accordingly, the circuits subsequent thereto are not operated, and the light-emitting diodes 15 are held inoperative. Furthermore, when the speed of a vehicle running toward the intersection of roads is comparatively high, the voltages of the points a and b rise earlier so that the detection distance of the vehicle is automatically made longer.

Figure 4:
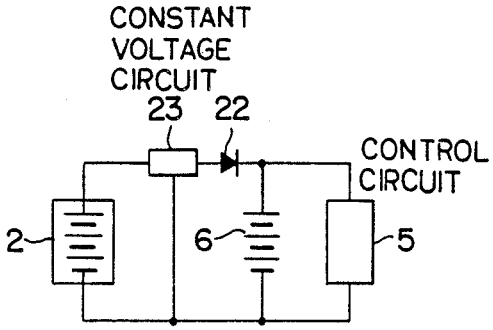
FIG. 4 is a diagram showing a circuit supplying electric power to the control circuit.

FIG. 4 illustrates a circuit for supplying electric power to the circuit 5. As is apparent in the drawing, a reverse current blocking diode 22 and a constant voltage circuit 23 are provided therein in addition to the solar cell 2 and the battery 6.

According to the present invention, the light-emitting diodes are operated in pulsation in response to the rate of variation of the quantity of light received from the incoming vehicle, so that any erroneous operation of the lighting peg caused by the ambient light such as street light can be substantially eliminated. Furthermore, the initial adjustment of the detectable distance of the vehicle sensors is not required, and since the detectable distance varies in accordance with the running speed of the incoming vehicle, a warning against an approach to the intersection is given to a vehicle driven at a distance adapted to the running speed.

Although an embodiment having a square outer casing adapted to a cross intersection has been described hereinabove, it is apparent that the shape of the casing, and the number of the vehicle sensors and the light emitting diodes may be adapted so that the lighting peg is advantageously installed along the stop line or the center of a road.

What is claimed is:

1. A lighting peg comprising:

an outer casing;

a solar cell provided on an upper surface of said casing;

a battery installed in said casing and connected in series with said solar cell;

a photoelectric conversion element provided on a side surface of said casing and connected in series with a variable resistor;

a differential circuit connected to an output side of said photoelectric conversion element;

a comparator comparing the output of said differential circuit with a reference voltage;

a multivibrator which generates output pulses when the output of said comparator is high level;

a counter which starts counting said pulses generated from said multivibrator when the output of said comparator becomes low level, and stops operation of said multivibrator when the counter counts a predetermined number of pulses; and a plurality of light emitting elements provided on the side surface of said casing to be operable in a pulsating manner when said multivibrator is operated.

2. The lighting peg according to claim 1 wherein said photoelectric conversion element combined with said differential circuit and said comparator provide a vehicle sensor which delivers a high level output when a variation rate of light received from an incoming vehicle is larger than a predetermined value.

3. The lighting peg according to claim 2 wherein said outer casing is formed into a square shape, and said photoelectric conversion element and said light emitting element are provided on each side of said square outer casing.

4. The lighting peg according to claim 3 wherein said differential circuit and said comparators are provided on each side of said square outer casing to provide four vehicle sensors, the outputs of said vehicle sensors are delivered through an OR gate to operate said multivibrator.

5. The lighting peg according to claim 4 wherein the output of said OR gate is applied through an inverter to an input of a NAND gate and also to reset terminal of said counter, while the output of said counter is applied to another input of said NAND gate, and the output of the NAND gate is applied to a transistor which starts operating said multivibrator.

6. The lighting peg according to claim 1 wherein a diode in a reverse polarity is connected across said differential circuit so that when the output of said differential circuit becomes a negative voltage, the output is charged to zero volt in a short time.

7. The lighting peg according to claim 1 wherein circuitry including said solar cell, battery, photoelectric conversion elements and light emitting elements is encased in said outer casing.

* * * * *